United States Patent [19]

Weisenfluh

[11] 4,056,191

[45] Nov. 1, 1977

[54] STUBLESS MULTI-PART ASSEMBLY

[75] Inventor: John A. Weisenfluh, North Tonawanda, N.Y.

[73] Assignee: Moore Business Forms, Inc., Niagara Falls, N.Y.

[21] Appl. No.: 723,247

[22] Filed: Sept. 15, 1976

[51] Int. Cl.[2] ..... B65D 27/14; B65D 27/34

[52] U.S. Cl. ..... 206/629; 206/632; 229/80; 282/22 R

[58] Field of Search ..... 282/22 R, 22 A, 23 R, 282/23 A, 24 R, 24 A, 24 B, 24 C, 11.5 R, 11.5 A; 229/68 R, 69, 85, 80

[56] References Cited

U.S. PATENT DOCUMENTS

| | | | |
|---|---|---|---|
| 1,949,625 | 3/1934 | Ritzhaupt | 282/22 R |
| 2,105,448 | 1/1938 | Brenn | 282/11.5 R |
| 2,105,449 | 1/1938 | Brenn | 282/11.5 R |
| 2,226,722 | 12/1940 | Jones | 282/22 R |
| 2,330,045 | 9/1943 | Georgiou | 229/85 |
| 3,149,859 | 9/1964 | Otis et al. | 282/11.5 A |
| 3,305,247 | 2/1967 | Fulk | 282/11.5 A |
| 3,325,188 | 6/1967 | Hiersteiner | 229/66 |

*Primary Examiner*—Stephen P. Garbe

[57] ABSTRACT

A unit set or assembly of several superimposed parts form a mailer without a stub, folded and detachable glue flaps being provided respectively along opposite sides of the first and second parts from the top, the flaps underlying and being secured to the last or bottom part of the assembly. Three-part or four-part mailer constructions are provided wherein the topmost part comprises a cover ply which, when removed, permits the assembly to be used as a mailer since the second part is secured to the fourth part in a four-part construction by means of glue from the first part flap extending through holes provided in the third part to thereby secure the second and fourth parts together. In the three-part construction, holes are provided in the bottom part so that the glue from the first part flap may extend therethrough so as to secure the second and third parts together.

5 Claims, 5 Drawing Figures

STUBLESS MULTI-PART ASSEMBLY

RELATED APPLICATIONS

This application relates to U.S. application Ser. No. 708,176, filed July 23, 1976, and to U.S. application Ser. No. 623,393, filed Oct. 17, 1975, both commonly owned herewith.

BACKGROUND OF THE INVENTION

Assemblies of several superimposed parts are generally detachably secured together by means of a common stub which, as pointed out in the above-mentioned related applications, obviously represents a completely unusable portion of the assembly since it cannot accept writing or printing and must be ultimately discarded. This wasteful use of the multi-part assembly applies equally as well to mailer constructions wherein one or more parts may be detachably connected to a stub.

SUMMARY OF THE INVENTION

It is therefore an object of the present invention to provide a multi-part assembly constructed for use as a mailer having a top removable cover ply or first part and which completely avoids provision of a stub thereby rendering the unit more economical and more usable from the standpoint of the writing material which may be carried by the several parts.

The stubless multi-part construction of the invention has detachable glue flaps along opposite edges of the first and second plies, respectively, from the top, the flaps being folded to underlie the bottom ply and being adhesively secured thereto. The intermediate ply is anchored in place as the glue on the top cover or first ply extends through marginal openings provided in the intermediate ply so as to thereby function as a rivet between the interconnected top and bottom plies. Holes may also be provided in the bottom part in axial alignment with the intermediate ply holes, except that the bottom ply holes are of a smaller size so as to partially mask the glue extending through the intermediate ply holes whereby the intermediate ply is released by simply separating the top and bottom plies so as to break the adhesive.

A three-part assembly is likewise contemplated by the invention wherein holes provided in the bottom ply permit the glue on the cover ply flap to extend therethrough so as to secure the intermediate ply in place.

Other objects, advantages and novel features of the invention will become more apparent from the detailed description thereof.

DETAILED DESCRIPTION OF THE INVENTION

Figure 1:
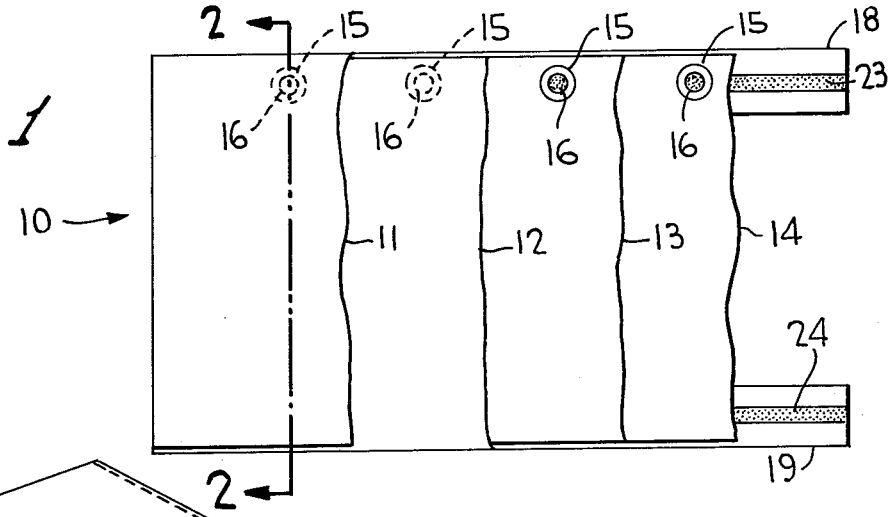
FIG. 1 is a top plan view of a multi-part mailer assembly constructed in accordance with the invention, several plies thereof being broken away for clarity.
Figure 3:
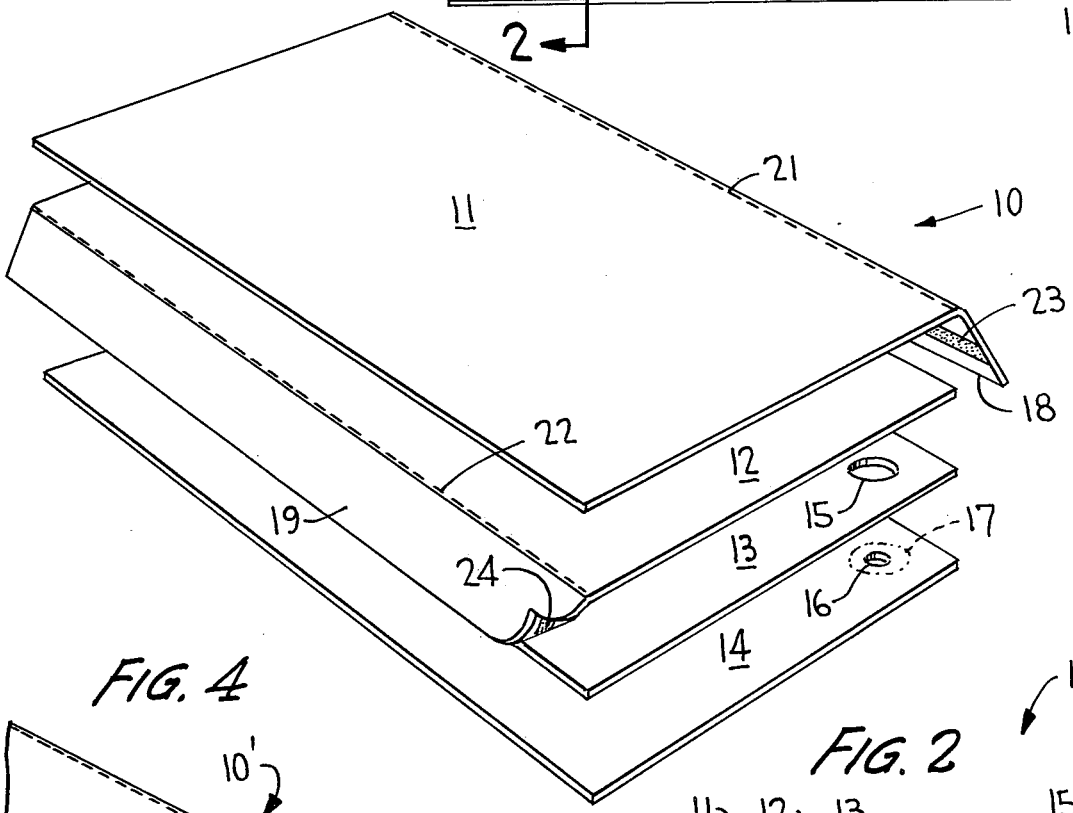
FIG. 3 is an expanded perspective view of the FIG. 1 assembly, slightly enlarged, showing the details of the invention.

Turning now to the drawings wherein like reference characters refer to like and corresponding parts throughout the several views, the assembly according to the invention is generally designated 10 in FIG. 1 and comprises several superimposed parts or plies as, for example, a cover ply 11 (first part), a top ply 12 (second part), an intermediate ply 13 (third part) and a bottom ply 14 (fourth part). It will become apparent that the assembly of FIG. 1 is a minimum four-part assembly and that additional like parts may be similarly superimposed without departing from the invention.

Holes 15, of some desired number and spacing, are provided along the marginal edge of part 13, holes 16 being provided in part 14 in axial alignment with holes 15, respectively. As shown, both sets of holes are circular with the diameter of holes 16 being smaller than that of holes 15. Nevertheless, both sets of holes may be of a different configuration so long as the relative size differential between them is maintained so as to define a mask portion 17 surrounding each hole 16 by virtue of this hole size differtial. The purpose and operation of the mask portions will be more clearly described hereinafter.

Part 11, the cover ply, has a flap 18 detachably connected along a marginal edge thereof by means of line 21 of weakening. And, a flap 19 is detachably secured along a marginal edge of part 12, such edge being opposite the edge along which flap 18 is secured. Flap 19 is made detachable as by line 22 of weakening, and both flaps have strips 23 and 24 of adhesive thereon for respectively securing the flaps to the underside of part 14.

Figure 2:
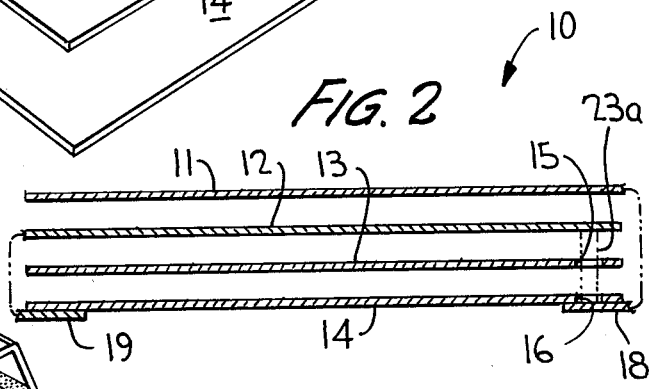
FIG. 2 is a cross-sectional view of the assembly taken substantially along line 2—2 of FIG. 1.

Portions **23*a* of the adhesive on flap 18 extend through aligned holes 15 and 16 whereupon parts 12 and 14 are adhesively secured together and, because of the different relative sizes of the aligned holes which define mask portions 17, portions 23*a* of adhesive are confined to the smaller sizes of holes 16 (see FIG. 2). These portions 23*a* therefore lie slightly inwardly of the margins of larger holes 15. Part 13 is therefore immobilized or anchored in place by glue portions 23*a* which act in the manner of rivets extending between parts 12 and 14**.

With such a construction as aforedescribed, it can be seen that assembly 10 comprises a mailer unit of interconnected parts 12, 13 and 14 open along its opposite sides perpendicular to line 22. Part 11 which serves as a cover or record ply may be removed from the assembly by tearing along line 21 of weakening whereupon the remaining interconnected parts 12, 13 and 14 remain intact. As typically provided for business forms on this type, sheets of carbon coated material may be interleaved between the four parts of the assembly, or carbonless transfer material may be coated on the mating surfaces of the four parts in whole or in part for the transfer of images from part 11 onto parts 12, 13 and 14. Cover ply 11 would normally be removed before the assembly is mailed so that, upon receipt by the addressee, part 12 may be completely separated from the assembly by tearing along line 22 and by pulling it away from the underlying parts so as to thereby break glue portions **23*a* for freeing each of the parts 12, 13 and 14 from one another. Or, it may be desirable to utilize the assembly other than as a mailer unit whereupon part 11 remains connected to part 14 and part 13 is pulled outwardly of one of the open sides whereupon parts 12 and 14** remain interconnected.

Figure 4:
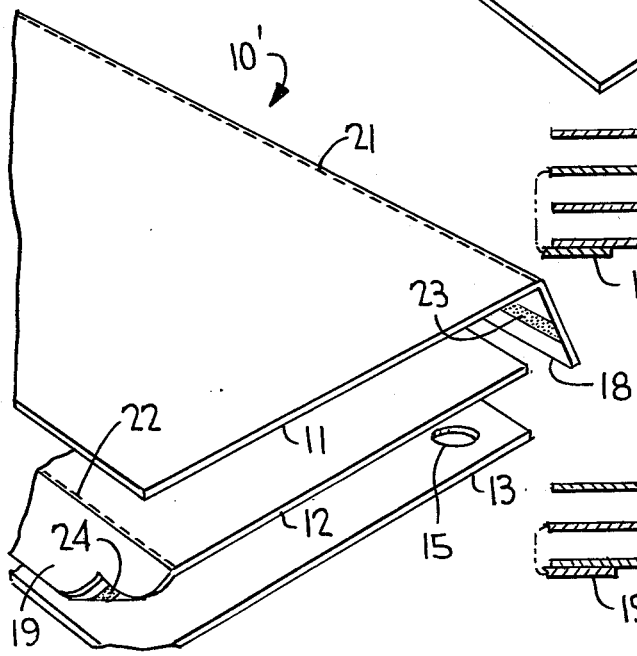
FIG. 4 is a view similar to FIG. 3 of another embodiment according to the invention.
Figure 5:
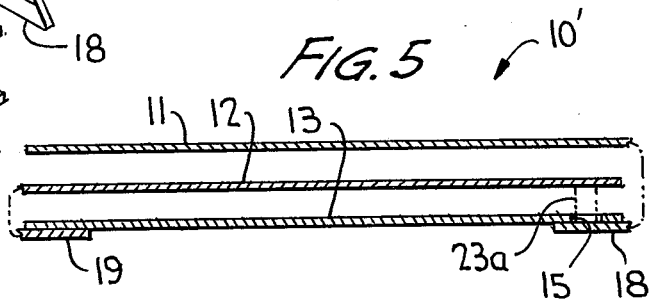
FIG. 5 is a sectional view similar to FIG. 2 of the FIG. 4 assembly.

In accordance with another embodiment of the invention, an assembly 10' is shown in FIGS. 4 and 5 as being similar to assembly 10 except that a three-part construction is formed of parts 11, 12 and 13 which are identical to like parts forming the assembly 10 construction. Glue flaps 18 and 19, respectively on opposite side edges of parts 11 and 12, underlie part 13 and are adhesively secured thereto as shown in FIG. 5. Portion 23*a* of adhesive 23 extends through each opening 15 of part 13 so as to secure parts 12 and 13 together. Assembly 10' may therefore be used similarly as assembly 10 by first removing part 11 as a record ply before the remaining parts forming a mailing unit are mailed out. Parts 12 and 13 thereupon remain intact and may be separated by tearing along line 22 of weakening and pulling part 12 away from part 13 so as to break adhesive portions 23*a*. Otherwise, assembly 10' may be utilized as a three-part business form whereupon removal of part 11 by tearing along line 21 and the separation of parts 12 and 13 as aforedescribed releases all the parts from one another.

It can be seen by those having ordinary skill in the art that a stubless business form unit has been devised whereupon paper waste has been eliminated since no stub need be discarded and each of the parts forming the assembly may receive a larger amount of writing as compared to a similarly sized stub assembly. The assemblies may be used as mailers or other types of business forms as desired.

Obviously, many modifications and variations of the invention are made possible in the light of the above teachings. It is therefore to be understood that within the scope of the appended claims the invention may be practiced otherwise than as specifically described.

What is claimed is:

1. A multi-part mailer construction, comprising superimposed first, second, third and fourth parts, said third part having at least one first hole therein of a predetermined first size along one of its margins, a quantity of detachable adhesive extending between said second and fourth parts and through said hole of said third part for securing said second and fourth parts together, said adhesive extending through said first hole having a cross-sectional size which is less than said predetermined size of said first hole so as to be spaced inwardly of the marginal edge of said first hole for retaining said third part in place, said first part having a first glue flap thereon underlying said fourth part and being secured thereto, said first flap being removably secured to said first part along a line of weakening located at one marginal edge thereof, and said second part having a second glue flap thereon underlying said fourth part and being secured thereto, said second flap being removably secured to said second part along a line of weakening located at a marginal edge opposite said one edge whereby said second and fourth parts are connected together and said third part is immobilized to form a mailer construction having open sides at other than said marginal edges with said first part detachably connected thereto along said first flap line of weakening, said one flap having said detachable adhesive thereon, and said parts each being devoid of any tear lines which may form a stub, whereby removal of said first part leaves said second, third and fourth parts intact, or separation of said second and fourth parts effects a break in said adhesive and frees said third part from the remaining of said parts while leaving said first and fourth parts interconnected, or removal of said first part together with separation of said second and fourth parts separates each of said parts from one another.

2. The mailer according to claim 1, wherein at least one second hole of a predetermined second size is provided in said fourth part in axial alignment with said first hole, said cross-sectional size of said adhesive being slightly greater than said second size of said second hole so as to contact the marginal edge thereof, and said second hole serving to mask said first hole for confining said adhesive to said cross-sectional size thereof.

3. The mailer according to claim 2, wherein a plurality of said aligned first and second holes are provided in said third and fourth parts, respectively.

4. A multi-part mailer construction, comprising, superimposed, top, intermediate and bottom parts and a cover ply disposed over said top part, a first glue flap detachably connected to said cover ply along a line of weakening located at one marginal edge thereof, a second glue flap detachably connected to said top ply along a line of weakening located at a marginal edge thereof opposite said one edge, said flaps underlying said bottom part and being adhesively secured thereto, first and second axially aligned holes of different sizes respectively provided in said bottom and intermediate parts, the size of said first hole being less than the size of said second hole, a portion of the glue on one of said flaps being detachable glue and extending through said aligned holes to thereby connect only said top and bottom parts together while immobilizing said intermediate part to form a mailer construction having open sides opposite said edges with said cover ply being detachably connected thereto along said first flap line of weakening, the size difference between said holes defining a portion of said bottom part which masks said second hole so as to confine the cross-sectional size of said glue portion to the smaller size of said first hole, and said parts each being devoid of any tear lines which may form a stub, whereby said cover ply may be removed from the mailer while leaving said parts intact, or separation of said top ply and said bottom part breaks said glue portion and frees said intermediate part from the mailer while leaving said cover ply and bottom part interconnected, or removal of said cover ply together with separation of said top and bottom parts separates said ply and said parts from one another.

5. A multi-part mailer construction, comprising superimposed top, intermediate and bottom parts, said top part having a folded first glue flap detachably connected thereto along a line of weakening located at one marginal edge thereof, said intermediate part having a folded second glue flap detachably connected thereto along a line of weakening located at a marginal edge opposite said one edge, said flaps underlying said bottom part and being secured thereto, said bottom part having at least one hole therein along one of its margins, the glue on said first flap being detachable glue and extending through said hole to thereby connect only said intermediate and bottom parts together into a mailer construction having open sides opposite said marginal edges with said top part detachably connected thereto along said first flap line of weakening, and said parts each being devoid of any tear lines which may form a stub, whereby removal of said top part leaves said intermediate and bottom parts intact, or removal of said intermediate part leaves said top and bottom parts interconnected, or removal of said top and intermediate parts separates each of said parts from one another.

* * * * *